US005614259A

United States Patent [19]

Yang et al.

[11] Patent Number: 5,614,259

[45] Date of Patent: Mar. 25, 1997

[54] MICROWAVE INTERACTIVE SUSCEPTORS AND METHODS OF PRODUCING THE SAME

[75] Inventors: Peter Y. Yang, San Diego; Graeme J. Fairlie, Alpine, both of Calif.

[73] Assignee: Deposition Technologies, Inc., San Diego, Calif.

[21] Appl. No.: 324,164

[22] Filed: Oct. 14, 1994

[51] Int. Cl.[6] ..... H05B 6/80

[52] U.S. Cl. ..... 427/255.1; 427/409; 427/497; 219/730; 219/759; 426/107; 426/234

[58] Field of Search ..... 219/730, 759; 426/107, 109, 234, 241, 243; 99/DIG. 14; 427/255.1, 409, 411, 497, 404; 428/34.2, 34.6, 34.7

[56] References Cited

U.S. PATENT DOCUMENTS

| | | | |
|---|---|---|---|
| 2,865,768 | 12/1958 | Barnes et al. . | |
| 3,999,040 | 12/1976 | Ellis | 219/543 |
| 4,230,924 | 10/1980 | Brastad et al. | 219/10.55 E |
| 4,262,072 | 4/1981 | Wendling et al. | 430/204 |
| 4,267,420 | 5/1981 | Brastad | 219/10.55 E |
| 4,363,851 | 12/1982 | Mishina et al. | 428/333 |
| 4,401,256 | 8/1983 | Krieg | 428/35 |
| 4,414,254 | 11/1983 | Iwata et al. | 428/34 |
| 4,518,651 | 5/1985 | Wolfe, Jr. | 428/308.8 |
| 4,557,980 | 12/1985 | Hodnett, III | 428/336 |
| 4,710,426 | 12/1987 | Stephens | 428/336 |
| 4,713,510 | 12/1987 | Quick et al. | 219/10.55 E |
| 4,735,513 | 4/1988 | Watkins et al. | 383/116 |
| 4,775,771 | 10/1988 | Pawlowski et al. | 219/10.55 E |
| 4,780,587 | 10/1988 | Brown | 219/10.55 E |
| 4,833,007 | 5/1989 | Huang | 428/242 |
| 4,842,893 | 6/1989 | Yializis | 427/44 |
| 4,962,000 | 10/1990 | Emslander et al. | 428/461 |
| 4,963,424 | 10/1990 | Beckett | 428/209 |
| 4,985,300 | 1/1991 | Huang | 428/332 |
| 4,985,606 | 1/1991 | Faller | 219/730 |
| 5,006,405 | 4/1991 | Watkins et al. | 428/323 |
| 5,035,945 | 6/1991 | Hart | 428/323 |
| 5,126,519 | 6/1992 | Peleg | 219/730 |
| 5,300,747 | 4/1994 | Simon | 219/729 |
| 5,340,649 | 8/1994 | Roeker et al. | 428/344 |

FOREIGN PATENT DOCUMENTS

| | | |
|---|---|---|
| 1168641 | 10/1969 | United Kingdom . |
| 87/02334 | 4/1987 | WIPO . |

OTHER PUBLICATIONS

"New Technologies to Improve Susceptor Efficiencies in Microwave Packages", Michael Andreasen, Optical Coating Laboratory, Inc. (Published and in the possession of applicants' assignee prior to Jun. 1, 1989).

*Primary Examiner*—Philip H. Leung
*Attorney, Agent, or Firm*—Juettner Pyle Lloyd & Piontek

[57] ABSTRACT

Microwave interactive susceptors in end product condition or form are produced by a continuous in-line production method wherein, under continuous vacuum, a paper or board substrate is first coated with a thin film of monomer which is cured to a polymer, a metal or other microwave interactive susceptor material is vapor or sputter deposited onto the polymer film, either in an overall layer or preselected pattern, and a thin film monomer is deposited over the susceptor layer and cured or polymerized resulting in an end product ready for use without the previously required polyester substrate and without requiring lamination of a metallized film to a paper or board backing. Production of plural layers susceptors is also disclosed.

14 Claims, 2 Drawing Sheets

MICROWAVE INTERACTIVE SUSCEPTORS AND METHODS OF PRODUCING THE SAME

FIELD OF THE INVENTION

The present invention relates to microwave interactive susceptors, particularly susceptors for use in the packaging and/or preparation of microwave food products, and to methods of producing the same.

BACKGROUND

Susceptors are employed in the preparation of food products in microwave ovens to convert some of the microwave energy to heat in order to assist in cooking the food by conduction, convection and/or radiant heating as well as microwave radiation. Susceptors may comprise the cooking surfaces of kitchen utensils, the bottom of packaged food products, such as unpopped popcorn, and a food wrap for a food product, such as meat or bread, which when cooked desirably should have a browned or crisped exterior surface.

Susceptors frequently comprise or are included in the packaging for food products as a convenience to the consumer, so that the consumer can simply pop the product into a microwave oven without any significant preparation. As a further convenience, such packaging is customarily disposable. Thus, there is a particular need for susceptors that are economical.

However, since susceptors will be brought into contact with foods intended for human consumption, it is necessary to encapsulate the microwave interactive material within films or the like that are approved for contact with food, thus resulting in a multi-layer susceptor product. Customarily, the susceptor product comprises a base sheet such as paper, cardboard, box board or the like, a thin film or foil of microwave interactive material, such as aluminum and other selected metals and alloys, and a heat resistant barrier film overlying the metal film or foil.

The multi-layer sheet may then be die cut or pressed into boxes or trays and/or decorated with printing to form a package into which food may be inserted by a food processor. Alternatively, the multi-layer sheet may comprise a flexible laminate which can be formed around a food product as a wrapping material at the food processor's plant.

The barrier film is typically a polyester because of its heat resistant properties and low cost. However, the barrier film may also be polyimide, cellulose, polyethylene nitrile and other heat resistant films. Its purpose is to provide a functional barrier between the food product and the metal, and sometimes also to serve as a sealable layer to facilitate formation of a package.

The microwave interactive susceptor material is typically a metal or metal alloy or derivative, in single or multi-layer formations, but also may be ceramic or carbon. Any element or compound that absorbs the electromagnetic microwave energy and converts it to radiant heat is suitable. The metals are usually applied by using evaporative or sputtering deposition methods. Flakes of metal are sometimes applied in a rotary printing process. Ceramics and carbon may also be applied in a rotary printing process.

Heretofore, it has been fairly common practice to deposit a film or layer of the microwave interactive material onto the barrier film, e.g., a web of polyester film, and to then laminate the metallized film onto a web of supporting substrate material, usually board, paper or cellulose.

SUMMARY OF THE INVENTION

The primary object of the present invention is to greatly simplify and significantly decrease the cost of producing multi-layer susceptor devices.

Another object is to facilitate the economical mass production of susceptors having improved and enhanced performance characteristics as compared to the susceptors conventionally used for packaging and/or preparation of microwave food products.

It is, in particular, an object of the invention to eliminate the need for and cost of the conventional barrier film and the process of laminating the film to a paper or board substrate.

The invention in its preferred embodiment is carried out by a creative combination of processes that are not individually new, but that have not heretofore been combined to provide the new use or uses contemplated by this invention. These known processes comprise, on the one hand, the polymer multi-layer or PML technique and, on the other hand, the metal vaporization and sputter deposition techniques.

In accordance with the invention, complete susceptors in final end product condition or form are produced in a single pass through an evacuated processing chamber wherein a selected substrate is first coated with a monomer which is cured to a polymer in accordance with PML technology, wherein a microwave interactive susceptor material is vapor or sputter deposited onto the polymer coated surface of the substrate, and wherein a monomer is deposited over the susceptor material and polymerized to form a barrier coating, thereby to produce in a single pass a multi-layer end product comprised of the substrate, a polymer coating, a film of microwave interactive material, and a protective barrier coating.

The substrate may be and preferably is one of the strong supporting materials conventionally employed, i.e., board, paper or cellulose, which may be fed through the processing chamber in the form either of discrete sheets or a continuous web.

The polymer coating applied to the substrate seals and smooths the rough and porous surface of the substrate, thereby conditioning the substrate surface for reception of a uniform, smooth and substantially continuous layer of microwave interactive susceptor material. This initial polymer coating is an important step in the process because the film or layer of microwave interactive material must have substantial continuity in order to function properly and must be of substantially uniform thickness in order to respond uniformly to microwave energy and thereby provide a source of radiant heat distributed uniformly over its surface. Without the initial coating, the rough and porous surface of uncoated paper or board would not be receptive of a vapor or sputter deposited film having the requisite characteristics.

Polymer multi-layer coating technology is employed to coat the substrate because it is fast and economical and promotes the application to the substrate of an incredibly smooth polymerized film. Also, since the process is carried out under vacuum, it is fully compatible with vacuum vaporization coating technology and sputter deposition technology.

The particular monomer employed for the initial coating is not especially critical, provided that it is compatible with PML coating technology, is strongly adherent to the substrate and receptive of the susceptor material, and forms a smooth, continuous and substantial impervious coating on the substrate. Monomers/polymers approved by the Food and Drug Anministration (FDA) for use with food products are preferred even though the initial coating will not itself come in contact with the food.

The microwave interactive material may comprise any of the materials that are customarily used for susceptors and that are capable of being vapor deposited or sputter deposited under vacuum. Aluminum is one example.

A particular advantage of the present invention resides in the fact that, because of the economies afforded by the process of manufacture, microwave interactive materials may now be utilized that were previously deemed inordinately or prohibitively expensive. Specifically, the process of the invention facilitates the utilization as susceptor materials of such alloys as stainless steel, Nichrome and Inconel previously deemed unsuitable because of cost. However, alloys provide specific advantages, for example, inherent heat stabilization at respective specific temperatures in contrast to the runaway heat characteristics of many less expensive metals such as aluminum. Thus, susceptors can now be provided that are heat stable and will not burn or burst into flames, and that are nevertheless sufficiently economical to warrant their use for practically all microwave food preparation and packaging applications.

The polymer coating applied over the microwave interactive susceptor material comprises the requisite barrier film for isolating the susceptor material from the food product. Since this coating will be in contact with the food, it is essential that the same comprise a monomer/polymer approved by the FDA for direct contact with food. While several materials are suitable for the purposes, an FDA approved acrylic monomer polymerizable to a smooth surfaced acrylate coating is preferred. Use of the PML technology for application and polymerization of this coating facilitates formation of an incredibly thin yet continuous and impermeable barrier film. A food protective barrier coating is therefore provided very inexpensively.

The invention thus provides an improved susceptor product enjoying significant cost advantages due to the process employed, the elimination of separate carrier films, and the elimination of the lamination process.

The invention also provides the advantage that the susceptor material, i.e., a metal, will not be subject to oxidation because it is deposited and encapsulated between polymer barrier layers entirely within a vacuum prior to any exposure to air.

Additional objects and advantages of the invention include the formation of susceptors having multilayer interactive format for optimum utilization of the layers to provide a blend of heating and shielding characteristics specifically tailored to a given food product; and the in-line single pass production of susceptors having interactive material deposited in a desired pattern for specific applications.

These and other objects and advantages of the invention will become apparent to those of reasonable skill in the art from the following detailed description, as considered in conjunction with the accompanying drawings.

DETAILED DESCRIPTION

The following is a detailed description of preferred embodiments of the invention presently deemed by the inventors to be the best mode of carrying out their invention.

Figure 1:
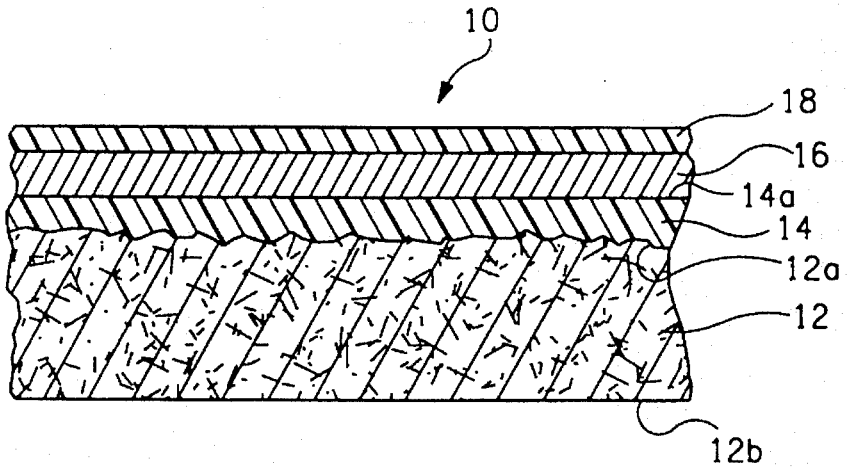
FIG. 1 is a schematic cross-sectional illustration, on a greatly magnified scale, of one embodiment of the susceptor of the invention.

FIG. 1 illustrates in cross section, on a magnified scale, a susceptor device 10 provided in accordance with the invention. The device is comprised of a strong supporting substrate 12, which usually and preferably comprises a sheet or web of an inexpensive packaging material such as paper, box board, cardboard, or cellulose. Such materials are fibrous and have an irregular and porous surface, as illustrated schematically at **12*a***. This surface is not suited for reception of a vapor or sputtered deposited susceptor material because of the inability to lay down a smooth continuous film of susceptor material on the rough and porous surface.

The surface **12*a* of the substrate 12 is, pursuant to the invention, prepared for reception of a thin film of susceptor material by application thereto of a thin film coating 14 of a polymer that is applied at a thickness sufficient to fill the voids and crevices in the surface 12*a* and provide a smooth impervious surface 14*a* for reception of a thin film 16** of susceptor material.

The susceptor material 16 may comprise any of the microwave interactive susceptor materials currently utilized in the industry, such as metals, alloys, oxides, ceramics and carbon. The preferred materials are those that can be vapor deposited and/or sputter deposited, such as aluminum, copper, tin, silver and the like. As will presently appear, a particular advantage of the invention resides in the ability to render economically feasible the use of susceptor materials heretofore deemed prohibitively expensive, especially alloys such as stainless steel, Nichrome and Inconel.

The thin film 16 of susceptor material is covered by a layer or coating 18, preferably a polymer, which serves to protect the thin film 16 from damage and to act as a barrier between the film 16 and the product to be heated by a combination of microwave energy and the radiant heat generated by the microwave interactive thin film 16. For microwave food product applications, the coating 18 must be a polymer generally regarded as safe (gras) and/or approved by the Food and Drug Administration (FDA) for direct contact with food.

The susceptor 10 of FIG. 1 is a finished end product ready for use. It may be die cut or pressed into boxes or trays and/or the exterior surface **12*b*** of the substrate may be decorated with printing to form part or all of a package for a product to be heated in a microwave oven.

Depending primarily upon the selection of the substrate 12, the susceptor device may be relatively stiff or rigid, e.g., for use as a tray, a package bottom, or a box, or it may be flexible, e.g., for wrapping about a microwavable product.

The susceptor devices of the invention do not embody and do not require the conventional metallized polyester film nor the conventional process step of laminating a metallized film to a paper or board substrate. The susceptors of the invention are therefore particularly economical and highly advantageous, A dual susceptor device provided in accordance with the invention is illustrated at 20 in FIG. 2. This device is comprised of a substrate 22, a primary coating 24, a first susceptor film 26-1 and a first dielectric protective coating 28-1, all essentially the same as or comparable to the elements 12, 14, 16 and 18 of the susceptor 10 illustrated in FIG. 1. In this instance, a second film 26-2 of susceptor material is deposited on the coating 28-1, which is dielectric, and the film 26-2 is covered by a protective barrier coating 28-2, which is also dielectric. Additional layers of susceptor material and dielectric coatings may be added if desired to provide a susceptor device comprised of a plurality of spaced and dielectrically isolated films of susceptor materials, which may be the same as or diverse from one another. Such plural layer susceptor devices have advantageous applications, especially in providing a blend of heating and shielding characteristics for selected uses.

Figure 3:
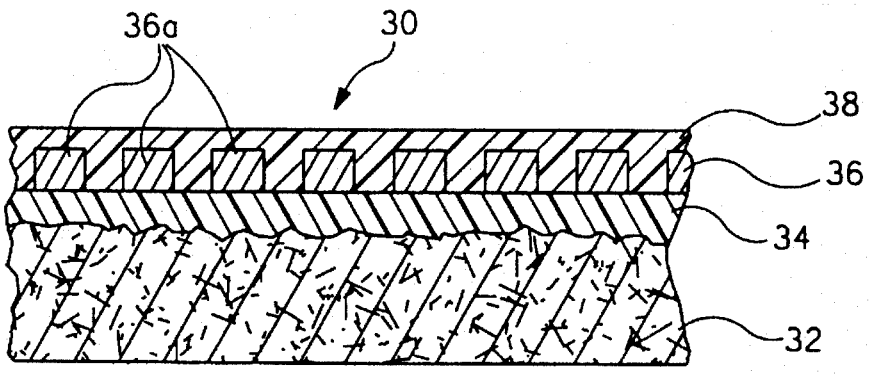
FIG. 3 is a schematic cross-sectional illustration, on a greatly magnified scale, of a third embodiment of the susceptor of the invention.

In addition, the invention facilitates the production of susceptor devices, either single layer or multiple layer, wherein the susceptor material is applied in a selected pattern in order to provide particular radiant heating characteristics, e.g., a selected blend or combination of microwave energy and radiant heat. Referring to FIG. 3, such a susceptor is illustrated at 30 as being comprised of a substrate 32, a substrate coating 34, a microwave interactive susceptor 36 and a protective top coating 38, generally the same as or comparable to the elements 12, 14, 16 and 18 of the FIG. 1 device. However, in this instance, the susceptor material is not applied in a continuous film of uniform thickness. Instead, it is applied in a pattern, one of which, for exemplary purposes, is illustrated in FIG. 3 as comprising a plurality of spaced parallel strips or stripes **36*a*** of the selected susceptor material. Other patterns of discrete interactive elements and/or patterns providing for variable interactive response to microwave energy, e.g., susceptor films of varying thicknesses, will be apparent to those of reasonable skill in the art.

While susceptor devices similar to the susceptor devices 10, 20 and 30 of the invention could be made in a variety of multiple step operations, the necessity for multiple handling of the substrate and multiple passes through diverse processing equipment would add cost to the end product and potentially render the product unacceptable to the food processing and packaging industry because of excessive cost and/or a mistakenly perceived reduction in quality not offset by a concomitant decrease in price.

A particular object of the present invention is to provide an efficient and economical method of manufacturing the improved susceptor devices of the invention so that the same will be readily accepted by the industry based on considerations both of price and performance characteristics. The method of the invention resides in a particular combination of polymer multiple layer ("PML") deposition technology and vapor or sputter deposition technology to produce microwave energy interactive susceptor devices in a single pass through a plurality of mutually compatible film depositing stations. Apparatus suitable for performing the method may take any of a number of forms known in the art, one example of which is illustrated in FIG. 4.

Figure 4:
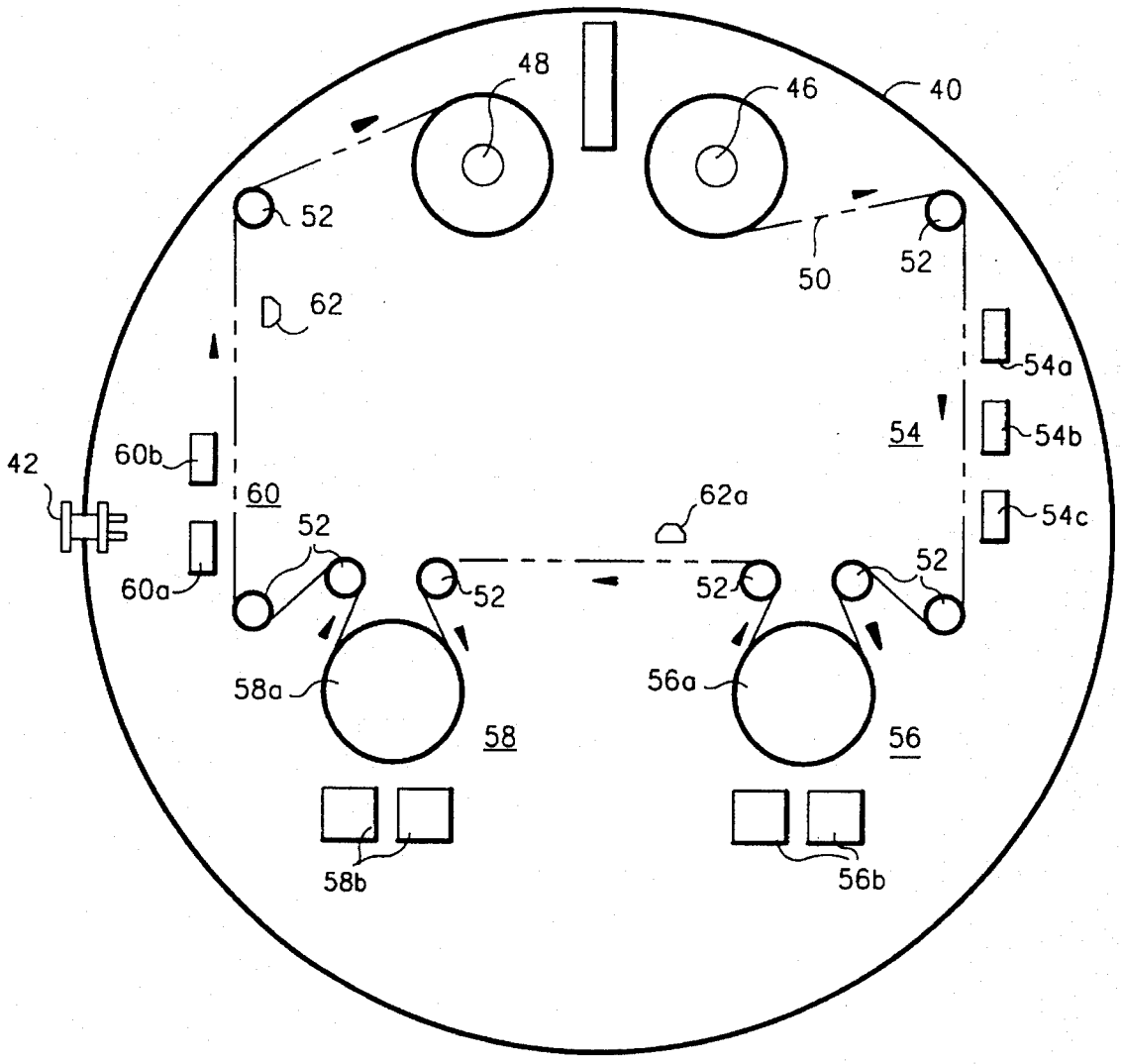
FIG. 4 is a schematic illustration of an apparatus for producing the susceptor devices of FIGS. 1–3.

As shown in FIG. 4, the film depositing apparatus is mounted in a vacuum chamber 40 equipped with means (not shown) for evacuating the chamber and means 42 for introducing into the chamber an inert gas and/or a partial pressure reactant. The chamber is provided with an unwind reel 46 for receiving a roll of continuous web substrate material intended to be coated and a wind-up reel 48 for winding up the web substrate material after it has been coated. As indicated by the dot-dash line, the web 50 is guided by a plurality of guide rollers 52 into and through a plurality of web coating stations. In the illustrated form of the apparatus, the stations include, in sequence in the direction of web travel, a prime coat station 54, a first susceptor material deposition station 56, a second susceptor material deposition station 58 and a top coat station 60.

The prime coat station 54 comprises an applicator **54*a* for evaporating and/or spraying a monomer onto the facing surface of the web 50, and a radiation apparatus 54*b* for curing and polymerizing the monomer as the web passes through the station 54. The radiation apparatus 54*b*** preferably comprises a device for generating an electron beam (E-beam) curtain through which or adjacent which the web passes.

The top coat station 60 similarly comprises a monomer applicator **60*a* and an E-Beam curing/ polymerizing apparatus 60*b***.

The two deposition stations 56 and 58 preferably comprise sputter deposition stations which are of the same construction and comprise, respectively, an internally chilled rotatable drum **56*a*, 58*a* of relatively large diameter for supporting and cooling the web and one or more magnetron cathodes 56*b*, 58*b* for sputter depositing a film of microwave interactive susceptor material onto the polymer coated surface of the web. Two sputter deposition stations are recommended so as to minimize the discharge requirements at each station, thereby to enhance the speed of the coating operation and minimize heat transfer to the web 50** of substrate material. Also, the space intervening between the two stations provides for a free run of the web so that additional cooling of the web may take place before the web reaches the second sputtering stage. It is further recommended that each sputtering station comprise a plurality of magnetron cathodes so that sputter deposition of the microwave interactive film is achieved in a plurality of stages or steps each of which is of relatively low dynamic intensity.

An optical monitor 62 is provided downstream from the topcoat station 60 to monitor the multi-layer coated web. One or more optical monitors (not illustrated in FIG. 4) may also be provided at the prime coat station 54 and one or both of the sputtering stations 56 and 58 to insure the proper thickness/thinness of the film of coating deposited at the respective station, thereby to provide requisite processing information.

In a typical coating operation, a roll of web substrate material is loaded onto the unwind reel 46 and threaded through the rolls in the illustrated path to the wind-up reel 48. The chamber 40 is closed and pumped down to a vacuum level of about $1\times10^{-6}$ torr. Argon or another inert gas is bled into the chamber to raise the pressure to about 1–10 millitorr. The prime and top coat stations are energized and the voltage on one or more of the cathodes is slowly raised to establish stable sputtering conditions at a desired power level. A web drive system (not shown) may then be activated to transport the web sequentially past the coating stations at a web speed of from about 20 to about 50 feet per minute, depending upon the susceptor characteristics desired. Generally, the whole roll of web substrate material will be coated and then removed from the chamber.

As will be observed, the susceptor devices 10 and 30 of FIGS. 1 and 3 may be produced in a continuous in-line operation, under vacuum, in a single pass of the web from the unwind reel 46 to the wind-up reel 48. During such movement of the web, a monomer is deposited un the substrate surface at the applicator **54*a* and is immediately cured and polymerized by passage through or adjacent the E-beam curtain generated by the apparatus 56*b*, thereby to form on the substrate surface the polymer prime coat 14 or 34**.

The web then moves to the sputter deposition stations 56 and 58 where a selected susceptor material is sputter deposited onto the polymer prime coat to form the microwave interactive layer or film 16 or 36. Depending upon the susceptor material selected, and the desired thickness of such material, the film 16 or 36 may be sputter deposited onto the polymer coated web by one or more or all of the magnetron cathodes **56*b*, 58*b***. Alternatively, the microwave interactive layer may be applied by vapor deposition techniques, although sputter deposition will usually be preferred, especially when employing microwave interactive alloys.

The substrate web then passes on to the station 60 where a monomer is evaporated and condensed, or is sprayed, onto the microwave interactive film by the applicator 60a and then cured and polymerized by the E-beam radiation apparatus **60*b*, thereby to form the protective top coat 18 or 38**.

When the entire web has thus been coated and wound up on the reel 48, the coating apparatus is deactivated and the reel of coated susceptor product is removed from the chamber 40. The susceptor web as removed from the chamber, following a single pass through the coating stations, comprises the end product of FIG. 1 or FIG. 3, ready for processing into package components and/or for delivery to a converter or a food processing or packing plant.

Figure 2:
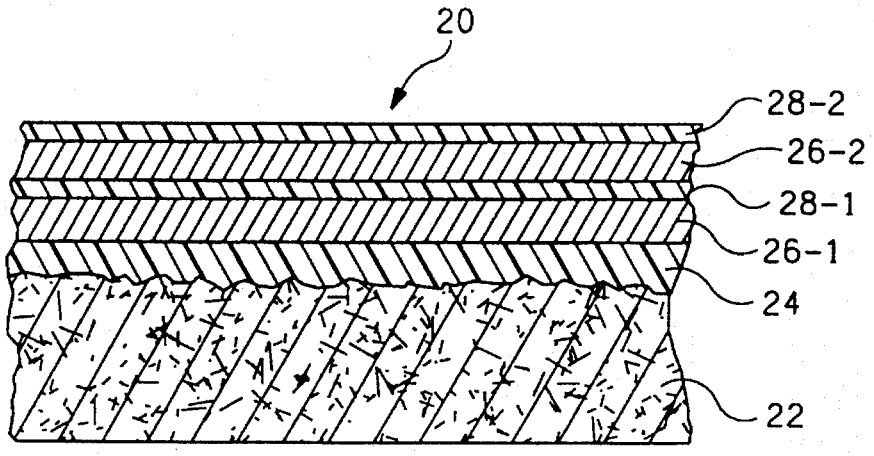
FIG. 2 is a schematic cross sectional illustration, on a greatly magnified scale, of a second embodiment of the susceptor of the invention.

The dual or multiple layer susceptor device 20 of FIG. 2 manifestly requires additional processing to complete the product. This may be accomplished by (a) the addition to the apparatus of another one or more susceptor deposition stations and polymer coating application stations, (b) one or more extra passes of the web through the illustrated apparatus, and (c) alternating reverse passes of the substrate web through the apparatus.

The addition of further coating stations will, of course, increase capital expenditures for both production equipment and plant space, but may be justified where the economies of mass production offset the added capital costs.

One or more additional passes of the web through the apparatus, though requiring multiple handling of the roll of web material, may well be justified to obtain the benefits of multiple susceptor layers, especially where the susceptor layers are to be formed of different susceptor materials and the apparatus has to be shut down between coating operations to accommodate substitution of the magnetron cathodes in order to switch from a first susceptor material to a second susceptor material. In coating operations conducted subsequent to those above described, it will not normally be necessary to operate the prime coat station 54 inasmuch as the first pass through the apparatus results in deposition on the substrate of the layers or films comprising elements 24, 26-1 and 28-1 of the susceptor device 20 of FIG. 2. Thus, a second pass through the stations 56, 58 and 60 will result in deposition of the second interactive film 26-2 and the protective top coating 28-2. In this fashion, multiple passes of the web through the apparatus will result in convenient and economical production of susceptor devices comprised of as many layers of susceptor material, or of as many different susceptor materials, as may be desired.

The option of alternately moving the web in opposite directions through the apparatus provides an exceptionally economical method for the production of susceptor devices having two or more interactive film layers, especially where the interactive film layers are formed of the same material and it is not necessary to shut the apparatus down to change the magnetron cathodes. Practice of this method eliminates multiple handling of the roll of substrate material and requires only the addition to the coating station 54 of a second monomer applicator **54*c* located at the side of the E-beam apparatus 54*b* opposite the applicator 54*a*, as is illustrated schematically in FIG. 4**.

In practice of this reverse direction method, upon loading a roll of web substrate material into the chamber 40, the applicator **54*a*, E-beam curing device 54*b*, one or more of the cathodes 56*b*, 58*b* and the coating station 60 will initially be energized and the web 50 moved in the direction of the arrows from reel 46 to reel 48 to apply to the web the layers or films 24, 26-1 and 28-1 illustrated in FIG. 2. When the whole roll of the web substrate has been coated, the coating station 60 and monomer applicator 56*a* will be deenergized, the applicator 56*c* energized and the web moved in the reverse direction from reel 48 to reel 46 thereby to apply to the web the second interactive layer 26-2 and the top protective or barrier coat 28-2. If a third interactive film is desired, the coating station 54 will be deenergized, the stations 56, 58 and 60 energized, and the web again moved in the first direction from reel 46 to reel 48**. Thus, without having to remove the roll of web material from the apparatus, the web can, by appropriate manipulation of the apparatus, be coated with as many films of susceptor materials as may be desired.

While practice of the method of the invention has been illustrated in FIG. 4 as being carried out within a cylindrical vacuum chamber 40, it should be understood that the method could as well be practiced in an elongate horizontal or vertical vacuum chamber wherein the coating stations 54, 56, 58 and 60 are arranged in an in-line sequence along the axis of the chamber and the substrate web 50 is moved in a more or less straight line path axially through the chamber. Such arrangement also facilitates the coating of discrete sheets of substrate material fed seriatim through the chamber.

As previously noted, the susceptor materials utilized in practice of the invention may comprise any of the microwave interactive susceptor materials that are conventionally employed in susceptor devices for preparation of microwave food products and that are capable of being deposited onto a substrate by vapor deposition and/or sputter deposition. However, the economies afforded by the method of the invention are such that the invention accommodates, indeed fosters, the use of microwave interactive materials that have much higher performance characteristics than the materials customarily employed.

In particular, the invention envisions extensive use of microwave interactive susceptor materials, particularly alloys such as stainless steel, Nichrome and Inconel, having specific advantageous properties or characteristics, but heretofore deemed too expensive to warrant their use; i.e., that the advantageous property or characteristic was not of sufficient commercial significance to justify the extra cost. For example, in contrast to the metals usually employed, stainless steel is known to have inherent heat stabilizing characteristics.

In a specific embodiment, a susceptor device 10 including a thin film 16 of stainless steel having a surface resistivity of about 500 ohms per square, when placed in a microwave oven, will rapidly heat up to about 375° F. and then remain at that temperature. It will not get any hotter than that in a conventional microwave oven environment. The radiant heat therefore stabilizes at 375°, which is an ideal temperature for browning or crisping the surface of a food product such as bread or meat. This temperature is also ideal for popping unpopped popcorn with minimal or no instances of either unpopped kernels or burnt kernels. Moreover, because of such heat stability, the stainless steel susceptor device is absolutely safe for use in a container made in part of paper or board, because paper, of which the outer layer of the container is formed, will not burn at a temperature less than about 450° F. Thus, inherent thermal regulation at a temperature lower than 450° F. assures safety in use of the container, even by children.

Thermal control at even lower, and thus safer, temperatures can be achieved by use of stainless steel films having a surface resistivity greater than about 500 ohms per square, e.g., up to about 2,000 ohms per square.

Despite this advantage, food processors declined to use stainless steel susceptor devices in the packaging of their products because the advantages purportedly did not justify the extra cost. The present invention reduces the cost sufficiently to overcome the economic barrier to use of highly advantageous susceptor materials, particularly stainless steel and other alloys.

In practice of the present invention, particularly when utilizing microwave interactive alloys, sputter deposition is preferred over vapor deposition because sputtering results in the deposition onto the polymer coated substrate of a thin film alloy having the same stoichiometric proportions as the original alloy. Sputter deposition thus assures retention of the temperature stability and/or other characteristics of the alloys. For elemental metals, vapor deposition would also suffice.

The microwave interactive film or films 16, 26-1, 26-2 and 36 of the susceptor devices of the invention preferably are deposited on the polymer coated substrate so as to have surface resistivities within the range of from about 200 to about 2000 ohms per square for alloys such as stainless steel, nichrome and Inconel, and from about 300 to about 2000 ohms per square for elemental metals such as aluminum, copper, tin, silver, nickel and zinc, depending upon the heating capability desired.

The radiation polymerizable monomers used in practice of the invention may be any of a number of monomers that will form any of the polymer materials heretofore found suitable for formation of a prime coating and/or a protective top coating having the characteristics above described. There is no requirement that the two coatings be the same as one another or even compatible with one another inasmuch as they are usually isolated from one another by an intervening layer or layers of microwave interactive material.

However, as a matter of practical convenience, it is usually desirable to utilize a single monomer that can be radiation cured to a polymer that is approved by the FDA and/or generally regarded as safe (gras) for use with food. Also, for many packaging applications, the top protective coating may advantageously be a heat sealable polymer and/or a polymer coated with a heat sealable material to facilitate fabrication of the packages.

Materials found particularly well suited for formation of the prime coating, the top coating and intervening dielectric coatings comprise acrylates formed by evaporation and electron beam (E-beam) polymerization of monomers having the general formula

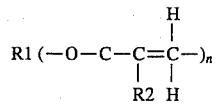

where R1 is an aliphatic or alicyclic radical and R2 is hydrogen or methyl, and which have a vapor pressure less than 1 minitorr at room temperature, and a vapor pressure up to 1 to 10 torr at 100 to 300 degrees C. before becoming chemically unstable.

In order to fill the crevices and interstices in the surface of a fibrous substrate, and to provide a smooth surface for reception of a susceptor film, the thickness of an acrylate prime coat 14, 24 or 34 should suitably be in the order of from about one to about four microns. An acrylate top coat 18, 28-2 or 38 may suitably have a thickness of from about 0.2 to about 2.0 microns. Dielectric coatings intervening between layers of interactive material may have a thickness in the order of from about 0.1 to about 1.0 microns. As previously noted, other radiation curable monomers may be utilized as well, all within the skill of the art.

Another key benefit of the method of the invention, that is not attained in current multipass methods of manufacture, is the ability to preserve the integrity and the freedom from oxidation of deposited films such as those of aluminum, copper, silver and the like that are prone to rapid oxidation. Due to the fact that, in practice of the method of the invention, the metal and the acrylates are applied in a continuous in-line operation in vacuum, in the presence only of an inert gas, the method eliminates the risk of oxidation or corrosion of the thin metal layer. The method is carried out continuously on a continuous web of substrate material, entirely within a vacuum chamber, without any intervening exposure to ambient air. Consequently, stable, durable, corrosion resistant metallized susceptor devices can readily be produced efficiently and economically at mass production speeds.

The objects and advantages of the invention have therefore been shown to be attained in a convenient, economical and practical manner.

While preferred embodiments of the invention have been herein illustrated and described, it is to be appreciated that various changes, rearrangements and modifications may be made therein without departing from the scope of the invention, as defined by the appended claims.

What is claimed is:

1. A method of producing susceptors for use in the packaging and/or preparation of microwave food products comprising the steps of providing a vacuum deposition chamber containing a first monomer deposit station, a first monomer curing station, a susceptor material deposition station, a second monomer deposit station and a second monomer curing station, introducing into the vacuum chamber a substrate comprising a sheet or web of paper, paperboard or like fibrous material, evacuating the chamber, moving the substrate sequentially past the first monomer deposit station, the first monomer curing station, the susceptor material deposition station, the second monomer deposit station and the second monomer curing station within the chamber, depositing a first thin film of a curable monomer onto the substrate to seal the fibrous surface of the substrate and form a smooth surfaced, uninterrupted, continuous layer of the monomer on the substrate, and curing the first film of monomer to polymerize the same, depositing a continuous, uninterrupted thin film of a microwave interactive susceptor material of uniform thickness onto the polymerized first thin film, depositing a continuous, uninterrupted second thin film of a curable monomer of uniform thickness onto the film of susceptor material and curing the second film of monomer to polymerize the same, and removing the coated substrate from the chamber, the coated substrate comprising a microwave interactive susceptor consisting essentially of a fibrous material substrate, a thin, continuous, uninterrupted, smooth surfaced first polymer film polymerized onto the substrate, a thin uniform, uninterrupted, continuous film. Of microwave interactive material on the first polymer film, and a thin, uniform, uninterrupted, continuous second polymer film polymerized onto and covering the film of microwave interactive susceptor material.

2. A method as set forth in claim 1 including the step of forming the coated substrate into a microwave food product utensil.

3. A method as set forth in claim 1 including the step of forming the coated substrate into a microwave food product package.

4. A method as set forth in claim 1 including the steps of cutting the coated substrate to selected size and incorporating the same in a microwave food product container.

5. A method as set forth in claim 1 wherein at least one of the monomer films is an acrylic monomer polymerizable to an acrylate.

6. A method as set forth in claim 1 wherein the microwave interactive susceptor material is selected from the group of metal alloys comprising stainless steel, inconel and nichrome.

7. A method as set forth in claim 1 including the step of depositing the microwave interactive susceptor material in a selected pattern.

8. A method as set forth in claim 1 including the steps of depositing a further uninterrupted, continuous film of microwave interactive susceptor material of uniform thickness onto the polymerized second thin film, and depositing a third uniform, uninterrupted, continuous thin film of a curable monomer onto the further film of susceptor material and curing the third film of monomer to polymerize the same.

9. A method as set forth in claim 8 wherein said first polymer film has a thickness of from about 1 to about 4 microns, each of said films of microwave interactive susceptor material has a surface resistivity of from about 200 to about 2000 ohms per square, said second polymer film has a thickness of from about 0.1 to about 1 microns, and said third polymer film has a thickness of from about 0.2 to about 2 microns.

10. A method as set forth in claim 1 wherein said first polymer film has a thickness of from about 1 to about 4 microns, said film of microwave interactive susceptor material has a surface resistivity of from about 200 to about 2000 ohms per square, and said second polymer film has a thickness of from about 0.2 to about 2 microns.

11. A method of producing susceptors for use in the packaging and/or preparation of microwave food products comprising the steps of providing a vacuum deposition chamber containing a first monomer deposit station, a first monomer curing station, a susceptor material deposition station, a second monomer deposit station and a second monomer curing station, introducing into the vacuum chamber a substrate comprising a sheet or web of paper, paperboard or like fibrous material, evacuating the chamber, moving the substrate sequentially past the first monomer deposit station, the first monomer curing station, the susceptor material deposition station, the second monomer deposit station and the second monomer curing station within the chamber, depositing a first coating of a curable monomer onto the substrate at the first monomer deposit station to seal the fibrous surface of the substrate and form a smooth surfaced, uninterrupted, continuous layer of the monomer on the substrate, curing the first monomer coating at the first monomer curing station to convert the monomer to a continuous, uninterrupted, smooth surfaced polymerized coating covering the substrate, depositing a continuous, uninterrupted film of a microwave interactive susceptor material of uniform thickness onto the polymerized first coating, depositing a continuous, uninterrupted second coating of a curable monomer of uniform thickness onto the film of susceptor material at the second monomer deposit station, curing the second monomer coating at the second monomer curing station to convert the monomer to a second polymerized coating covering the film of susceptor material, and removing the coated substrate from the vacuum chamber.

12. A method as set forth in claim 11 wherein one or the other or both of the monomer coatings comprises an acrylic monomer polymerizable to an acrylate.

13. A method as set forth in claim 11, wherein the, film of microwave interactive susceptor material is deposited in a selected pattern.

14. A method as set forth in claim 11 including the steps of depositing a second film of microwave interactive susceptor material onto the polymerized second coating, depositing a third coating of a curable monomer onto the second film of susceptor material, and curing the third monomer coating to convert the monomer to a third polymerized coating covering the second film of susceptor material.

* * * * *